US007985116B2

(12) United States Patent
Song et al.

(10) Patent No.: US 7,985,116 B2
(45) Date of Patent: Jul. 26, 2011

(54) PIECE WITH MAGNETS FOR BUILDING A TOY

(75) Inventors: Kyoung Woon Song, Seongnam-si (KR); Jong Sung Kim, Incheon (KR)

(73) Assignee: Edtoy Co., Ltd., Bupyeong-Gu, Incheon (KR)

( * ) Notice: Subject to any disclaimer, the term of this patent is extended or adjusted under 35 U.S.C. 154(b) by 228 days.

(21) Appl. No.: 12/402,742

(22) Filed: Mar. 12, 2009

(65) Prior Publication Data

US 2009/0197500 A1 Aug. 6, 2009

Related U.S. Application Data

(63) Continuation-in-part of application No. 12/440,933, filed as application No. PCT/KR2007/004248 on Sep. 4, 2007.

(30) Foreign Application Priority Data

Sep. 13, 2006 (KR) ..... 10-2006-0088369

(51) Int. Cl.
*A63H 33/26* (2006.01)

(52) U.S. Cl. ..... 446/92; 446/129

(58) Field of Classification Search ..... 446/92, 446/129–139, 168; 273/155, 157
See application file for complete search history.

(56) References Cited

U.S. PATENT DOCUMENTS

| | | | | |
|---|---|---|---|---|
| 2,970,388 | A | 2/1961 | Yonkers | 35/18 |
| 5,152,711 | A | 10/1992 | Gross | 446/139 |
| 6,749,480 | B1 | 6/2004 | Hunts | |
| 6,846,216 | B1 | 1/2005 | Balanchi | 446/85 |
| 6,969,294 | B2 | 11/2005 | Vicentelli | 446/92 |
| 7,413,493 | B2 | 8/2008 | Toht et al. | |
| 2004/0116038 | A1 | 6/2004 | Hunts | 446/92 |
| 2006/0240737 | A1 | 10/2006 | Yoon | 446/92 |
| 2007/0287353 | A1 | 12/2007 | Vicentelli | 446/92 |

FOREIGN PATENT DOCUMENTS

| | | |
|---|---|---|
| JP | 09-140855 | 6/1997 |
| KR | 10-2004-0065186 | 7/2004 |

OTHER PUBLICATIONS

International Search Report dated Dec. 21, 2007.
Office Action dated Oct. 21, 2010 issued in U.S. Appl. No. 12/440,933.
U.S. Office Action issued in U.S. Appl. No. 12/408,132 dated Mar. 24, 2011. (Ibs-0001.02).
International Search Report dated Dec. 21, 2007.

*Primary Examiner* — Nini Legesse
(74) *Attorney, Agent, or Firm* — Ked & Associates LLP

(57) ABSTRACT

Provided is there a piece with a magnet for building a toy, and more particularly to a piece with a magnet for building a toy, the piece having at least two or more end and a magnet case having a magnet with south and north pole faces inside, rotatably provided on each end, capable of connecting to the other piece of the same construction, without sliding with respect to each other, by automatically enabling the north or south pole face of the one magnet to be opposite to the south or north pole face of the other magnet.

8 Claims, 4 Drawing Sheets

[Fig. 1]
PRIOR ART
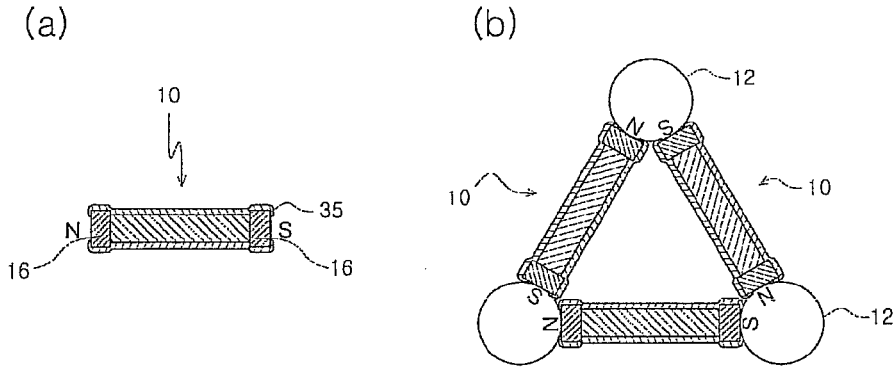
[Fig. 2]
PRIOR ART
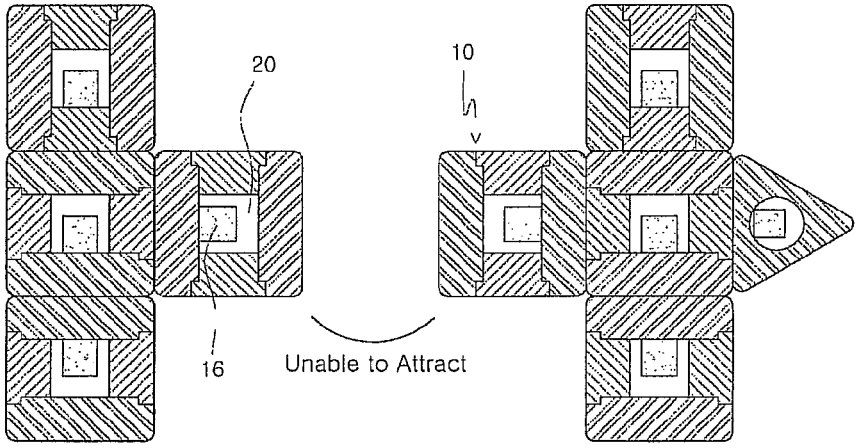
[Fig. 3]
PRIOR ART
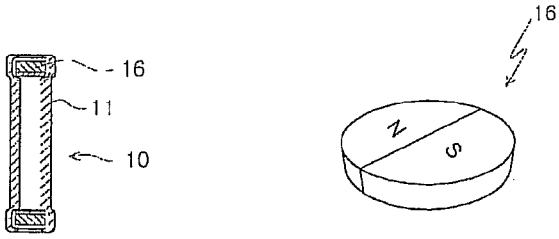
[Fig. 4]
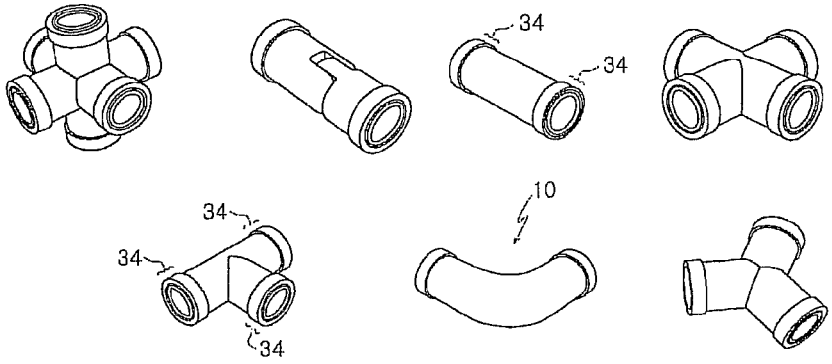

[Fig. 5]
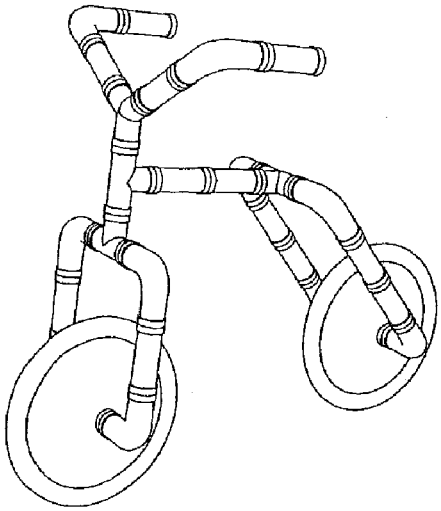
[Fig. 6]
(a)
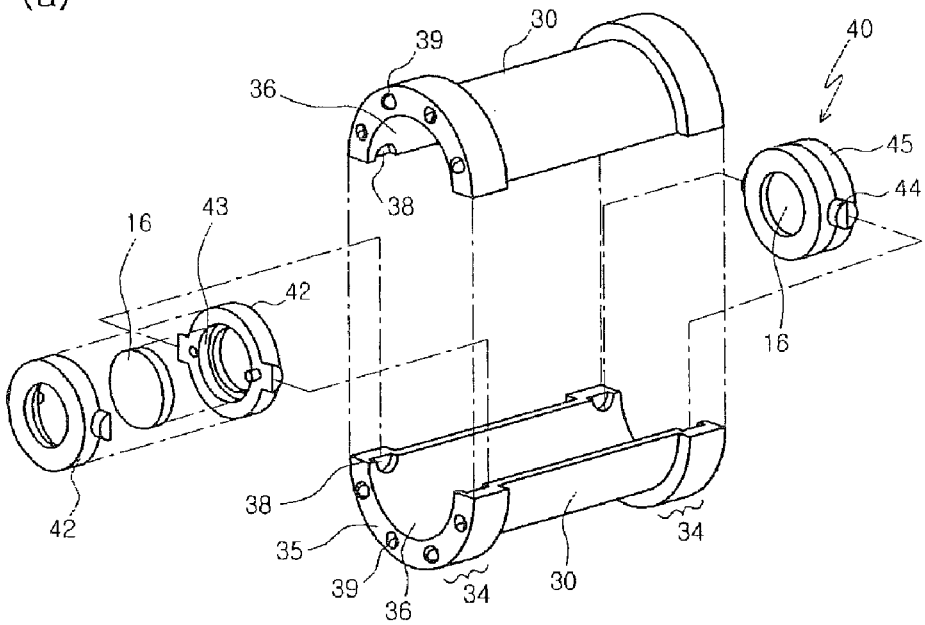
(b)
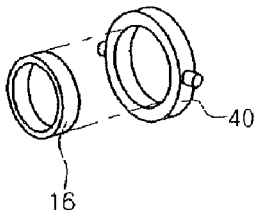

[Fig. 7]
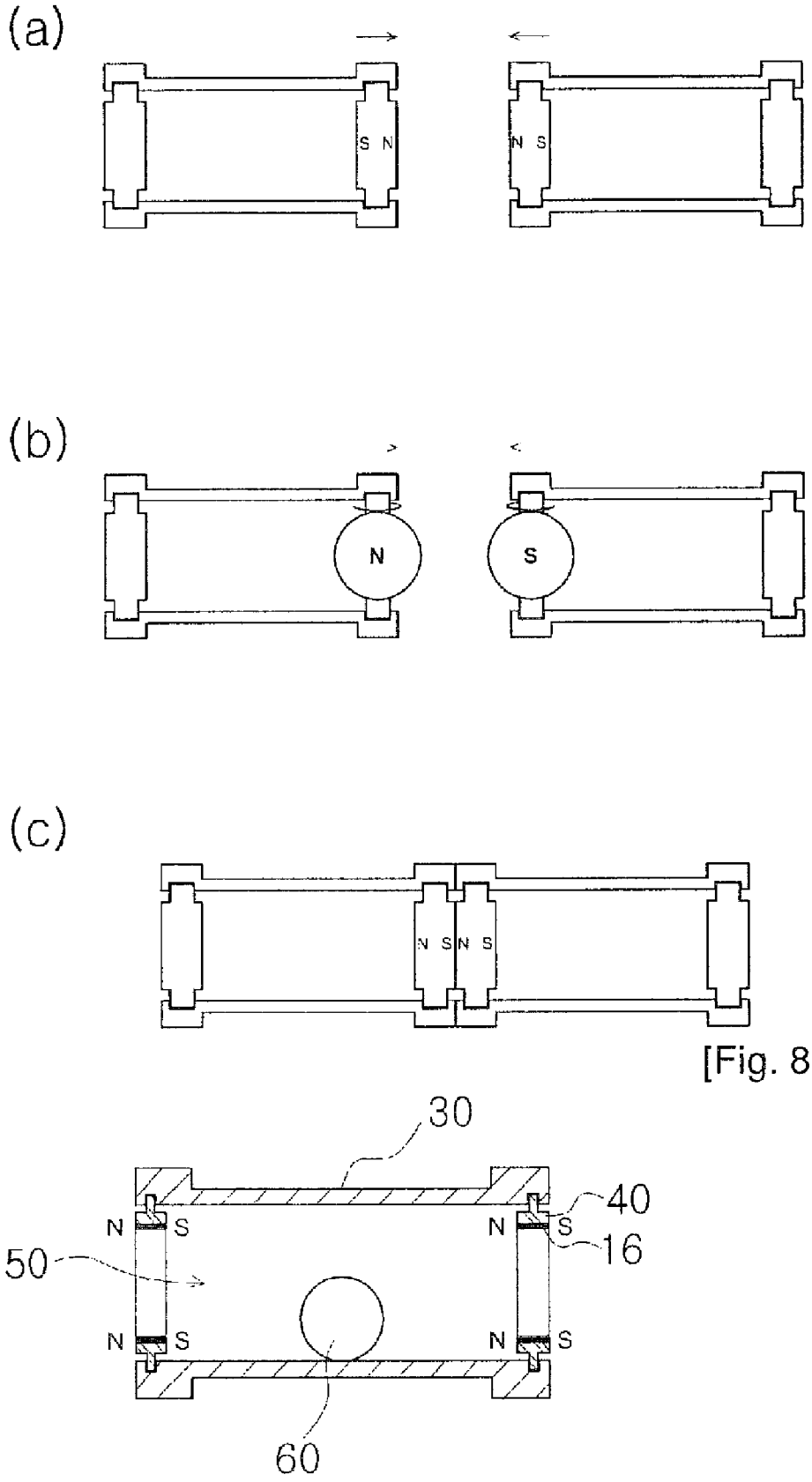
[Fig. 8]

[Fig. 9]
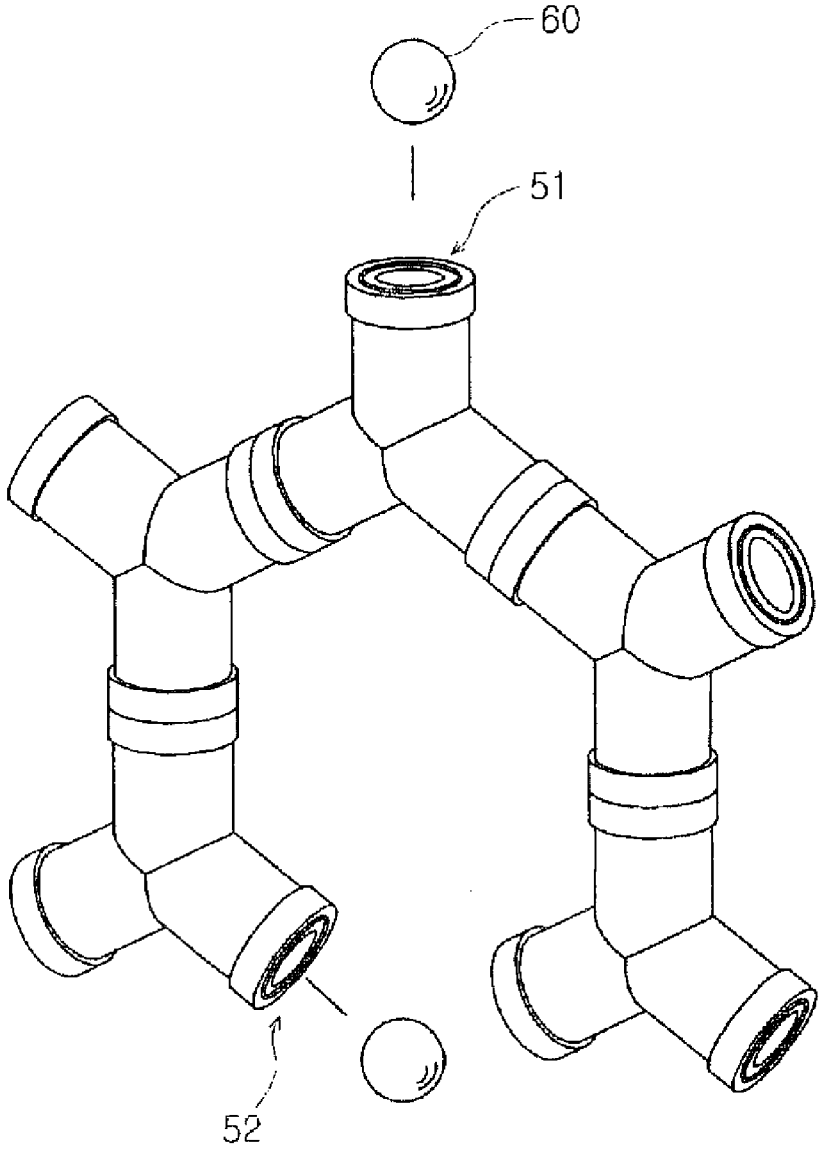
[Fig. 10]
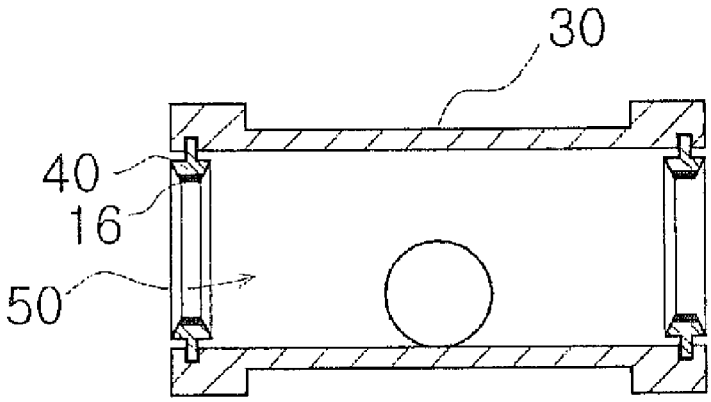

PIECE WITH MAGNETS FOR BUILDING A TOY

This application is a Continuation-In-Part of U.S. patent application Ser. No. 12/440,933 filed Mar. 12, 2009, which is the National Stage Application of PCT/KR2007/004248 filed Sep. 4, 2007, which claims priority of Korean Patent Application No. 10-2006-0088369, filed on Sep. 13, 2006, whose entire disclosures therein are incorporated by reference herein.

TECHNICAL FIELD

This disclosure relates to a magnetic toy.

BACKGROUND ART

A piece for building a toy, having a protrusion on one side and an insertion hole in the other side are in wide use to foster children's creativity. Children can play creatively while building a toy by inserting the protrusion on the one side of one piece into the insertion hole in the other side of the other piece.

A new-type of piece with magnets for building a toy is growing in popularity, which connects to the other piece with magnets to build a toy.

The piece 10, as shown in FIG. 1, has two magnets 16 on ends, one on each end. The magnet 16, provided fixedly on each end of the piece 10 has its south pole face toward outside and the magnet 16 on the other end of the piece 10 has its north pole face toward outside. The two pieces 10, which are the same in construction, connects to each other with a magnetic ball 12 to build a variety of toys. However, contact surfaces 35 of the two pieces 10, when having like poles, cannot connect to each other without the magnetic ball 12. It's because like poles repel and unlike poles attract. So, any one of the two pieces 10 has to turn 180 degrees.

A conventional technology of solving this problem is described in Korean Patent No. 545658. In the conventional technology, a piece 10 for building a toy has a space 20 inside, where a magnet 16 is placed. The magnets 16 are freely movable or rotatable in the spaces 20 when the like poles are opposite to each other. Thus, when unlike poles are opposite to each other, the two pieces 10 connect with each other by magnetic forces.

However, the space 20 should be large enough for the magnet 16 to be freely movable or rotatable in it. This makes it difficult for the piece 10 to be small-sized. The small-sized piece 10 requires the corresponding small-sized space 20, which in return requires the use of the small-sized magnet 16. When the small-sized magnet is placed in the space 20, the magnet force is smaller. Furthermore, when two toys are independently built connecting the pieces, they can connect to each other later. Two or more magnets have to be placed in the space 20 to connect the independently-built toys. This requires the larger-sized space 20, thereby making it difficult for the piece to be small-sized. Children cannot easily distinguish between the piece which has two or more magnets in it, and the piece which has one magnet in it.

Another conventional technology of connecting the pieces without having to use the magnetic ball is disclosed in Korean Utility Model Registration No. 404030. The piece 10, as shown in FIG. 3, has a circular magnet 16, of which one face has both north and south poles, on the contact surface 35. The circular magnet 16 is rotatable along the inside circumferential surface 11 of the body. However, this causes friction between the outside circumferential surface of the magnet 16 and the inside circumferential surface 11 of the body, thereby preventing smooth rotation of the magnet 16. Furthermore, the magnet 16 whose one face has both north and south poles is expensive, thereby increasing a cost for manufacturing the piece 10 with this construction.

DESCRIPTION OF DRAWINGS

The accompanying drawings, which are included to provide a further understanding and are incorporated in and constitute a part of this specification, illustrate various embodiments and together with the description serve to explain the principles of the embodiments.

FIG. 1 is a view of a conventional piece with magnets for building a toy.

FIG. 2 is a view of another conventional piece with a magnet for building a toy.

FIG. 3 is a view of another conventional piece with a magnet for building a toy.

FIG. 4 is a view of a variety of appearance of a piece with a magnet for building a toy according to the present disclosure.

FIG. 5 is a view of a toy which is built using the pieces with a magnet for building a toy according to the present disclosure.

FIG. 6 is an exploded, perspective view of construction of the pieces with a magnet for building a toy according to the present disclosure.

FIG. 7 is a view illustrating a principle of connecting the pieces connect to build a toy.

FIG. 8 is a view of a piece with a magnet for building a toy according to another embodiment of the present disclosure.

FIG. 9 is a view of another toy which is built using the pieces of FIG. 8.

FIG. 10 is a view of another embodiment of the magnet-holding case and another embodiment of the magnet.

DETAILED DESCRIPTION

The present disclosure relates to a piece with magnets for building a toy, and more particularly to a piece with magnets for building a toy, the piece having at least two or more ends and a magnet-holding case having a magnet with south and north pole faces inside, rotatably provided on each end, capable of connecting to the other piece of the same construction, without sliding with respect to each other, by automatically enabling the north or south pole face of the one magnet to be opposite to the south or north pole face of the other magnet.

The piece 10, as shown in FIG. 4, may have two or more ends 34. A bicycle toy, as shown in FIG. 5, may be built using a various shape of the pieces 10 with the ends 34.

The bar-shaped piece 10 with the two ends 34 is now described. The same principle of automatically enabling the north or south pole face of the one magnet to be opposite to the south or north pole face of the other magnet is also applied to the piece 10 with the three or more ends 34.

The piece 10 with magnets for building a toy according to the disclosure, as shown in FIG. 6, includes a body 30, a magnet 16, and a magnet-holding case 40.

The magnet 16 employed in the piece with magnets for building a toy according to the disclosure has north and south pole faces in the form of a circle. The magnet 16 like this is available at a low cost.

The magnet-holding case 40 includes a frame 42 and two spindles 44. The magnet 16 is mounted inside the frame 42. Two spindles 44 are provided on the lateral side 45 of the frame 42, one in one direction, and the other in the opposite direction. So, the two spindles 44 protrude from the frame 42. As shown in FIG. 6, the magnet-holding case 40 is separated into two halves, each half having a groove 43 inside. After the magnet 16 is inserted into any one of the grooves 43 in the two halves, the two halves are assembled into the magnet-holding case 30.

Any shape of the frame 42 can be employed if it is a suitable one that the magnet 16 is mounted inside. For example, a circle-shaped frame with a small thickness may be provided which has a pieced hole inside. The magnet 16 is attached around an inside circumferential surface of the circle-shaped frame, using an adhesive agent. Otherwise, a circle-shaped flexible frame with a small thickness may be provided which has a pieced hole inside and has a groove in the inside circumferential surface. The magnet 16 can be inserted into the groove, resulting in being held in place.

As shown in FIG. 6, the two pole faces of the magnet 16 are exposed to air. The magnet may be installed inside the frame 42, thereby preventing the two pole faces of the magnet 16 from being exposed to air.

As shown in FIG. 6, the piece has the body 30 with the two ends, and a spindle-holding hole 38, which the spindle 44 is inserted into, is provided inside each end 34. The body 30 is lengthwise dissembled into two halves. The spindle 44 is inserted into the spindle-holding hole 38. Then, the two halves are assembled back into the body 30. In this way, the magnet 16 is mounted inside the end of the body 30, thereby being held in place.

A way for mounting the magnet-holding case 40 in the body 30 is not limited to one as shown in FIG. 6. The body 30 may be provided as a single body, not separable lengthwise into the two halves. The end of the body 30 have a groove in the inside circumferential surface. The spindle 44 of the magnet-holding case 40 is pushed inward to be inserted into the groove and then the blocking material is used to block up the groove to hold the magnet-holding case 40 in place inside the end of the single body 30. The flexible body 30 may be provided as a single body, not separable lengthwise into the two halves. Two holes, opposite to each other, are in the inside circumferential surface of the flexible body 30. The spindles 44 of the magnet-holding case 40 fit into the holes in the inside circumferential surface of the flexible body 30, one spindle 44 in each hole. Thus, the magnet-holding case 40 rotates about its spindles 44 fitting into the holes. The magnet-holding case 40 with the spindles 44 are pushed inside the flexible body 30. At this point, the flexible body 30 is expanded to allow the spindles 44 to enter inside the flexible body 30 and fit into the two holes. After the spindles 44 fit into the two holes, the flexible body 30 maintains its original shape.

Difference between the width of the groove and the diameter of the spindle 44 is such that the magnet-holding case 40 can smoothly rotate with the spindle 44 being held in place inside the end of the single body 30. The body 30 and the magnet-holding case 44 have to be concentric to enable the magnet-holding case 40 to smoothly rotate about the spindles 44.

The body 30, as shown in FIG. 6, is hollow. That is, the body 30 has a pierced hole. However, the body 30 may have a magnet-case space 36 inside only on each end. The magnet-case space 36 has to be large enough for the magnet-holding case 40 to freely rotate.

The magnet-holding case 40 can freely rotate in the cylindrical space inside the body 30, as shown in FIG. 6. So, there is no need for separately providing the magnet-case space 36 where the magnet-holding case 40 to freely rotate.

As shown in FIG. 6, the spindle 44 and the spindle-holding holes 38 are provided on the magnet-holding case 40 and the body 30, respectively. However, the spindle 44 and the spindle-holding holes 38 may be provided on the body 30 and the magnet-holding case 40. In this variation, the method may be accordingly changed for installing the magnet-holding case 40, to enable the magnet-holding case 40 to rotate about the spindles 44. The variation is equivalent to a structural relationship between the spindle 44 and the body 30.

FIG. 7 is a view illustrating a principle of connecting the pieces, as shown in FIG. 6 to build a toy. FIG. 7A shows that the contact surfaces of the two pieces 10, which are to come in contact with each other, have like poles. FIG. 7B shows that like poles repel, thereby rotating the magnet-holding case 40 about the spindle 44. FIG. 7C shows that unlike poles attract, thereby making the contact surfaces of the two pieces 10 come in contact with each other. Thus, the two pieces connects to each other.

In this way, the pieces can connect to each other to build various kinds of toys. However, the connected pieces may slide with respect to each other, owing to their own weights. This makes the built toy dissembled into the discrete pieces 10.

To prevent this problem, a slide-prevention part 39 may be provided on the contact surface 35. The slide-prevention part includes indentations and protrusions which are alternately formed on the contact surface 35, at a given interval of distance. The indentations and protrusions on the contact surface 35 of one piece 10 are matched with the protrusions and indentations on the contact surface 35 of the other piece 10, thereby preventing the two contact surface 35 from sliding with respect to each other.

The slide-prevention part 39 is not limited to one shown in FIG. 6, but includes radial prominences and radial depressions which are formed on the contact surface 35, alternatively and successively.

FIG. 8 is a view of a piece with magnets for building a toy according to another embodiment. The piece has a body 30 having a pierced hole 50, a ring-shaped magnet 16, and a frame 40. With these configuration and construction, the piece 10 has a passage inside. The passage has openings on each end.

A kid can build a toy with entrance-openings 51 and exit-openings 52, as shown in FIG. 9, using the pieces with the passage inside. He/she can play a game of locating the exit-opening 52 from which a bead 60 falls when the bead 60 is put into the entrance-opening 51.

A diameter of the pierced hole 50 is large enough for the bead 60 to pass through the pierced hole 50.

The magnet 16 and/or the frame 40, as shown in FIG. 10, may have a tapered inside circumferential surface to easily allow the bead 60 to easily pass through the pieces 10 which connect to each other.

The pieces may be made of transparent or semi-transparent material, so the bead 60 can be seen to pass through a passage from the entrance-opening 51 to the exit-openings 52.

A sealing layer (not shown), such as a rubber or silicon layer, may be formed on the contact surface 35. This is done to prevent liquid from leaking between the contact surfaces 35 when the two pieces 10 connect to each other. The toy, as shown in FIG. 9, can be built using the pieces with the sealing layer on the contact layer 35. Liquid, when used instead of the bead, can be seen to flow through the passage from the entrance-opening 51 to the exit-openings 52.

The pieces with magnets for building a toy can connect to each other by magnetic forces to build a variety of toys without having to use a separate magnetic ball which serves as a tool for connecting the two pieces. The magnet employed in the piece has north and south pole faces and therefore available at a low cost. When the toy is built using the pieces, the passage with entrance- or exit-openings is formed inside the toy. A bead or liquid can pass through this passage. Building sets of the pieces may be ideal for stimulating the creative, innovative and expressive skills of young children.

As disclosed herein, a piece with a magnet with south and north pole faces for building a toy, is capable of connecting to the other piece of the same construction, without sliding with respect to each other, by automatically enabling the north or south pole face of the one magnet to be opposite to the south or north pole face of the other magnet.

As disclosed herein, a hollow piece with a magnet with south and north pole faces for building a toy, is capable of connecting to the other piece of the same construction, without sliding with respect to each other, by automatically enabling the north or south pole face of the one magnet to be opposite to the south or north pole face of the other magnet, and capable of providing a passage through which to pass a fluid or ball inside the toy when the toy is built.

According to an aspect of the embodiment, there is provided a piece with magnets for building a toy, including a body including a plurality of ends, a magnet-case space provided inside each end, and two spindle-holding holes, a magnet having north and south pole faces, and a magnet-holding case including a frame inside which the magnet is mounted, and two spindles protruding in opposition directions from a lateral side of the frame, which are inserted into the two spindle-holding holes to enable the magnet-holding case to rotate about the two spindles, wherein the body includes two halves which are detachable from each other to install the magnet-holding case and attachable to each other to hold the magnet-holding case in place.

The body, the magnet, and the frame all may have a pierced hole in the middle. The pierced hole is large enough for a bead to pass through.

The piece may have a slide-prevention part on the contact surface. The slide-prevention part serves to prevent the contact surfaces of the pieces from sliding with respect to each other, when the pieces connect to each other.

The piece may have a sealing layer on the contact surface. The sealing layer serves to prevent fluid from leaking between the contact surfaces when the pieces connect to each other.

The body may be made of transparent or semi-transparent material.

The present invention has an advantage of a simple structure of the evaporator provided in the quick freezer compartment because the evaporator for the quick freezer compartment uses the refrigerant passing the evaporator for the freezer or refrigerator compartment. Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A piece with a magnet for building a toy, comprising:
- a magnet having north and south pole faces;
- a magnet-holding case comprising a frame inside which the magnet is mounted, and at least one spindle provided on the frame; and
- a body comprising
  - a plurality of ends;
  - at least one spindle-holding hole, provided in an inside circumferential surface of each end, into which the at least one spindle is inserted; and
  - a magnet-case space, provided inside each end, wherein the magnet-holding case rotates about the least one spindle, wherein a plurality of indentations and protrusions are alternately and successively formed on a contact surface of each end, at a given interval of distance or radial prominences and radial depressions which prevent the contact surfaces from sliding with respect to contact surfaces of other pieces, and wherein the body, the magnet, and the frame all have a pierced hole in a middle thereof, which is large enough for a bead to pass through.

2. The piece with a magnet for building a toy according to claim 1, wherein a sealing layer is formed on the contact surface.

3. The piece with a magnet for building a toy according to claim 1, wherein the magnet and/or the frame have a tapered inside circumferential surface.

4. The piece with a magnet for building a toy according to claim 1, wherein the body is made of transparent or semi-transparent material.

5. The piece with a magnet for building a toy according to claim 1, wherein the body includes two halves which are detachable from each other to install the magnet-holding case and attachable to each other to hold the magnet-holding case in place.

6. The piece with a magnet for building a toy according to claim 1, wherein the at least one spindle comprises two spindles and the at least one spindle-holding hole comprises two spindle holding holes, into which the two spindles are inserted, wherein the magnet-holding case rotates about the two spindles.

7. The piece with a magnet for building a toy according to claim 1, wherein the magnet is mounted inside the frame of the magnet-holding case by an adhesive.

8. The piece with a magnet for building a toy according to claim 1, wherein the frame of the magnet-holding case includes a groove formed of a flexible material along an inner periphery of the frame and the magnet is fittingly inserted into the groove of the frame.

* * * * *